US006888512B1

(12) United States Patent
Daigler

(10) Patent No.: US 6,888,512 B1
(45) Date of Patent: May 3, 2005

(54) MOBILE TELESCOPIC ANTENNA MOUNT FOR WIRELESS NETWORKING SITE SURVEYS

(76) Inventor: David John Daigler, 1757 State Highway 162, Sprakers, NY (US) 12166

( * ) Notice: Subject to any disclaimer, the term of this patent is extended or adjusted under 35 U.S.C. 154(b) by 81 days.

(21) Appl. No.: 10/634,087

(22) Filed: Aug. 4, 2003

(51) Int. Cl.[7] ..... H01Q 1/12
(52) U.S. Cl. ..... 343/878; 348/143
(58) Field of Search ..... 343/878, 880, 343/881, 882, 883; 455/11.1, 7, 422; 348/143, 139, 159

(56) References Cited

U.S. PATENT DOCUMENTS

| | | | | |
|---|---|---|---|---|
| 4,185,288 A | * | 1/1980 | Dosch et al. | 343/765 |
| 5,531,419 A | | 7/1996 | Gustafsson et al. | 248/519 |
| 5,787,111 A | | 7/1998 | Gilmore | 375/200 |
| 5,850,713 A | | 12/1998 | Hojo | 52/115 |
| 6,104,910 A | * | 8/2000 | Koths | 455/11.1 |
| 2002/0025836 A1 | | 2/2002 | Knight | 455/562 |
| 2002/0176712 A1 | * | 11/2002 | Brown | 396/427 |
| 2003/0025791 A1 | * | 2/2003 | Kaylor et al. | 348/143 |

OTHER PUBLICATIONS

Terra Wave Solutions, TWS–ROD–002, http://www.terra–wave.com/Search.bok!category=Site+Survey+Tools.

* cited by examiner

*Primary Examiner*—Hoang V. Nguyen

(57) ABSTRACT

A mobile telescopic antenna mount consisting of a platform 10, a mast base 11, a mast 1, a mounting plate 26 and horizontal arms 9. The platform 10 has wheels 7 mounted to in for mobility. The platform 10 also has handles 16 for carrying the platform 10 and eye bolts 17 for attaching a power source(s) by use of rubber straps 21. The mast base 11 attaches vertically to the platform 10 and receives the mast 1. The mast 1 is telescopic. A universal mounting plate 26 and horizontal arms 9 attach to the top of the mast 1 via a PVC cross 5. In its assembled state, the antenna mount retains full mobility while the power source provides electrical power to the mounted devices. In its disassembled state, the antenna mount becomes compact and easily transportable.

2 Claims, 4 Drawing Sheets

MOBILE TELESCOPIC ANTENNA MOUNT FOR WIRELESS NETWORKING SITE SURVEYS

CROSS-REFERENCE TO RELATED APPLICATIONS

Not Applicable.

FEDERALLY SPONSORED RESEARCH

Not Applicable.

SEQUENCE LISTING OR PROGRAM

Not Applicable.

BACKGROUND OF THE INVENTION—FIELD OF INVENTION

This invention relates to antenna mounts, specifically to such antenna mounts which are used for wireless networking site surveys.

BACKGROUND OF THE INVENTION

One step in the process of installing a wireless computer network is to determine the location of the antennas for the access points. This process is referred to as the "site survey". These access points send and receive information between computer networks and devices that employ wireless networking technology. Because these antennas have a limited range, geographic placement of the antennas is crucial to providing adequate signal to the wireless devices. Because these antennas need to be elevated, a method of elevating and positioning the antennas needs to be employed during the site survey. The most common method of doing this is to rent or own a hydraulic lift or to use ladders. Both of these methods are dangerous because people are elevated with the antennas. The method of using a hydraulic lift is very expensive.

Thereafter, the only invention I have found during my search to address the issues of cost and safety is the Site Survey Extension Pole by Terrawave Solutions, Inc. I have not found any patent on this product. Although this invention addresses the issue of not needing ladders or a hydraulic lift to elevate the antennas during the site survey, the invention does not address the issue of providing power for the access points and the invention loses its mobility once erected. The loss of mobility will effect the speed in which the site survey can be performed and the lack of power will require extension cords to be used. If the building is new and does not have its electrical service installed yet, the Terrawave Solutions, Inc. device may not be an option at all.

BACKGROUND OF INVENTION—OBJECTS AND ADVANTAGES

Accordingly, several objects and advantages of my invention are:

(a) to provide an antenna mount that independently retains its mobility once erected
(b) to provide an antenna mount that incorporates an independent electrical power source
(c) to provide an antenna mount that is weighted at the base for better stability
(d) to provide an antenna mount that can be disassembled for easy transport
(e) to provide an antenna mount that accepts various types of antennas (f) to provide an antenna mount that will allow a single person to perform a wireless networking site survey
(g) to provide an antenna mount that will significantly reduce the cost of the site survey for a wireless networking site survey
(h) to provide an antenna mount that will not require a person to become elevated during a wireless networking site survey.

SUMMARY

In accordance with the present invention an antenna mount comprising of a mobile platform, an antenna mast base, an antenna mast and a universal cross member for mounting various types of access points and antennas.

DRAWINGS—FIGURES

DRAWINGS—REFERENCE NUMERALS

Figure 1A:
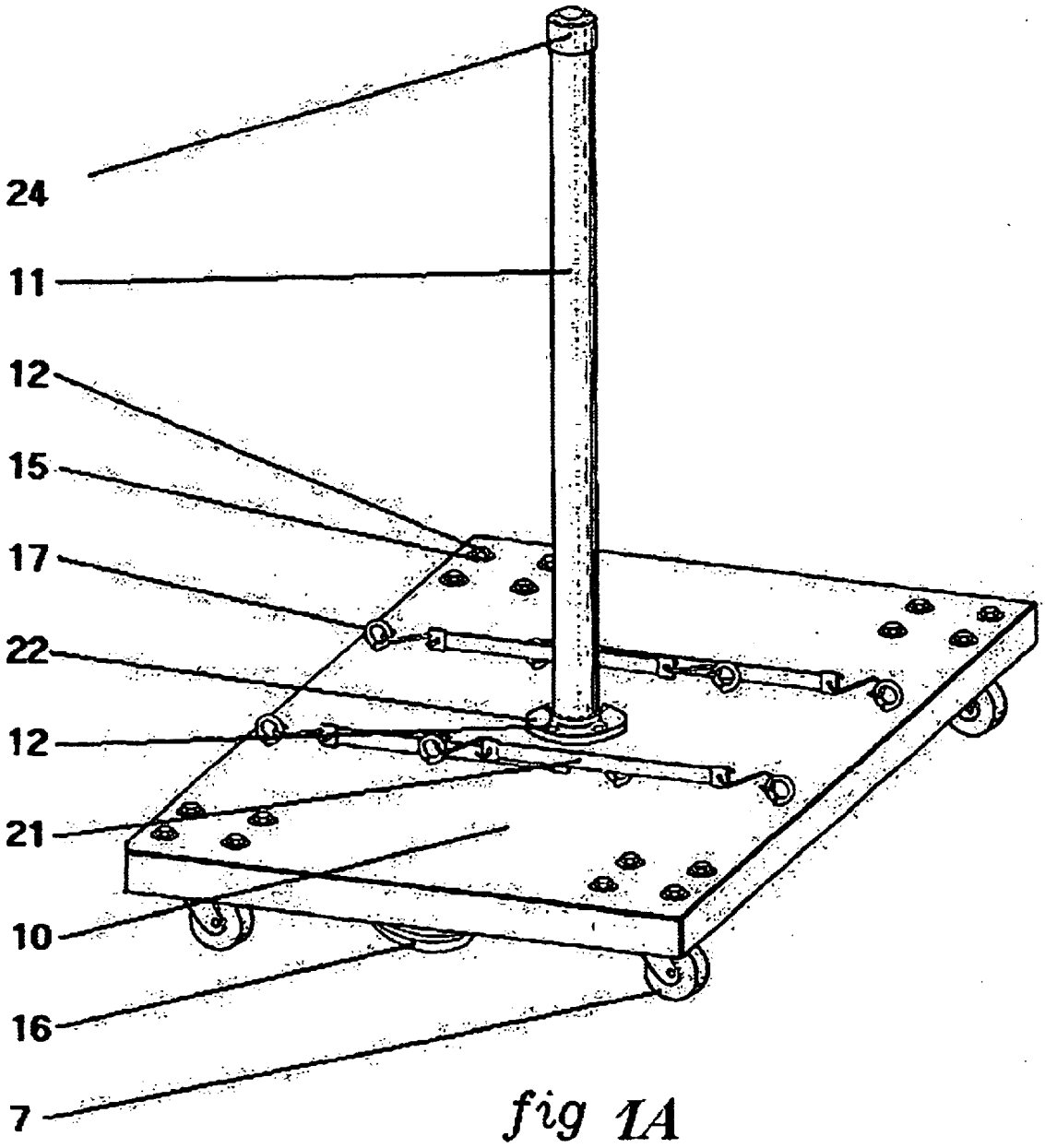
FIG. 1A shows the mobile platform with the mast base attached and the rubber straps that will hold down the uninterruptible power supplies.
Figure 2A:
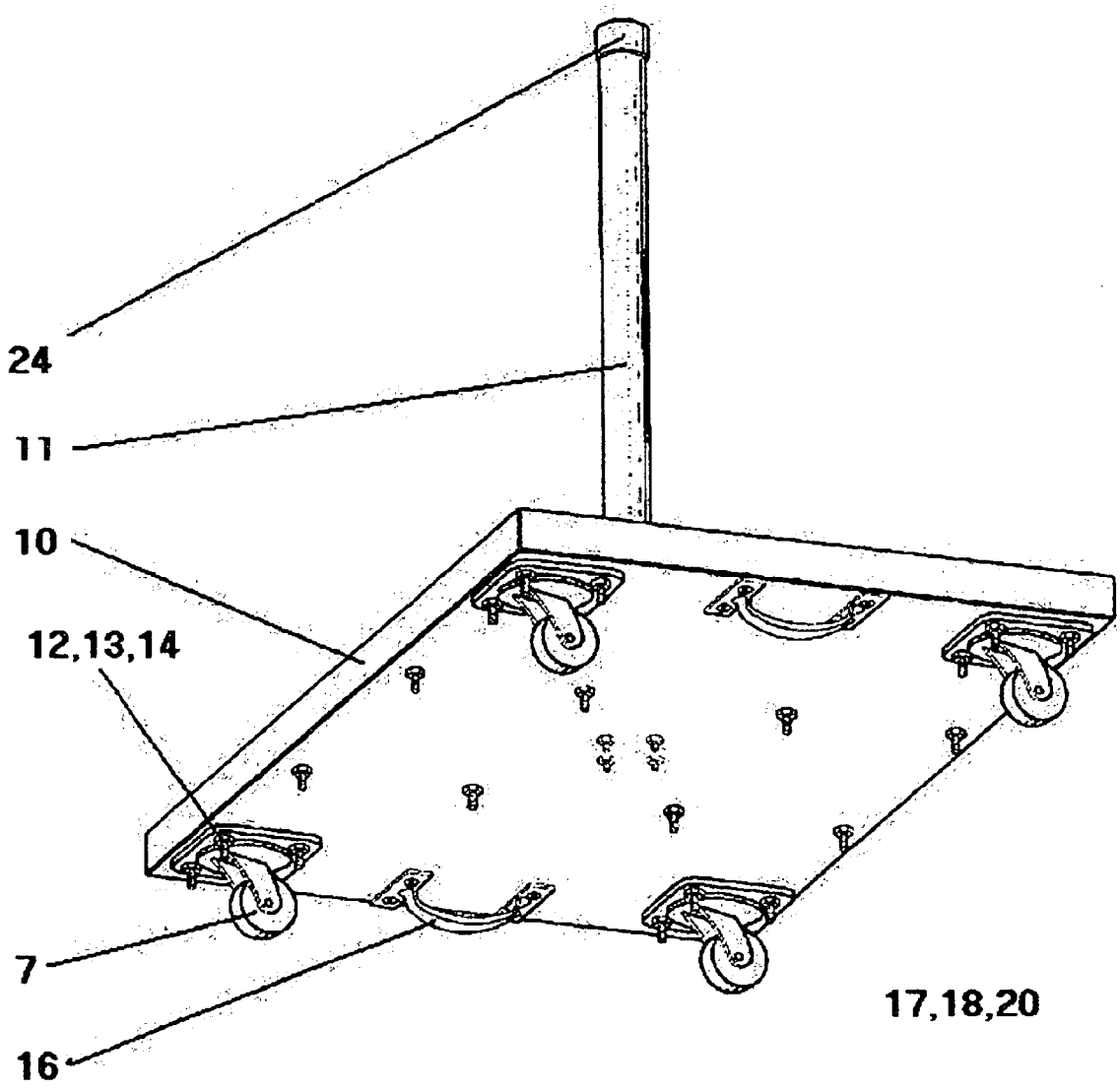
FIG. 2A shows the underside of the platform with the mast base attached.
Figure 3A:
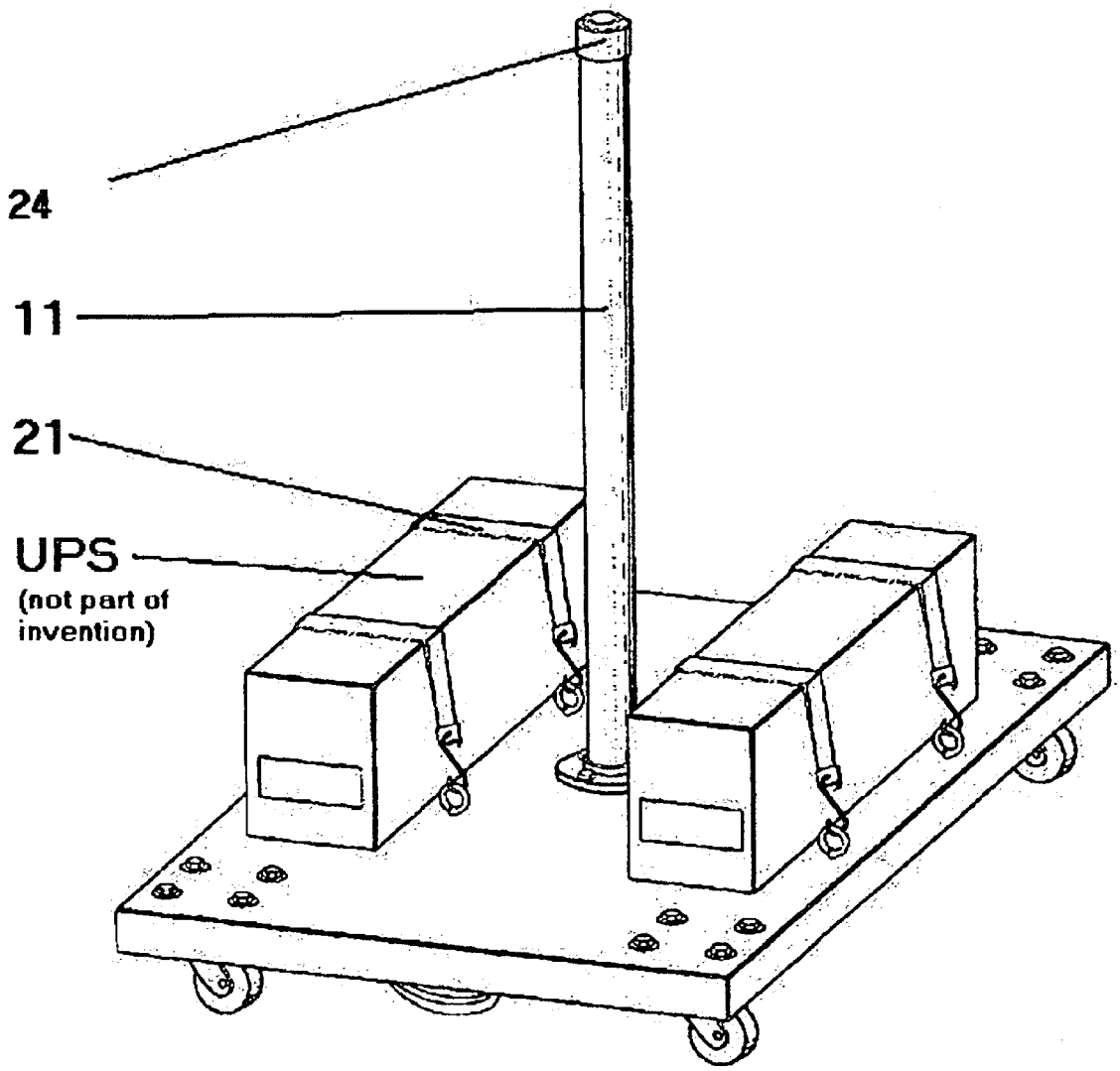
FIG. 3A shows the platform and mast base with 2 uninterruptible power supplies strapped to the platform. The uninterruptible power supplies are not a part of the invention, but when incorporated, provide electrical power for the access point and weight to the platform for stability.

1 16 foot telescopic pole
3 1 inch PVC bushing
4 1 inch PVC tee
5 1 inch PVC cross
7 2½inch locking caster
8 1 inch by 1 inch angle aluminum
9 1 inch schedule 40 PVC pipe
10 2 foot by 2 foot ¾ BC plywood
11 30 inch by 1¼inch galvanized threaded pipe
12 5/16 inch threaded bolt
13 5/16 inch threaded nut
14 5/16 inch lock washer
15 5/16 inch washer
16 6½ inch door pull
17 ¼ inch eye bolt with nut
21 rubber tarp strap
22 1¼inch floor flange
23 ¼ inch by 2 inch hitch pin
24 1¼ inch threaded PVC cap
26 tie plate
27 jack chain
30 1 inch self tapping sheet metal screw

DETAILED DESCRIPTION—FIGS. 1A, 4A, 4B—PREFERRED EMBODIMENT

Figures 4A, 4B:
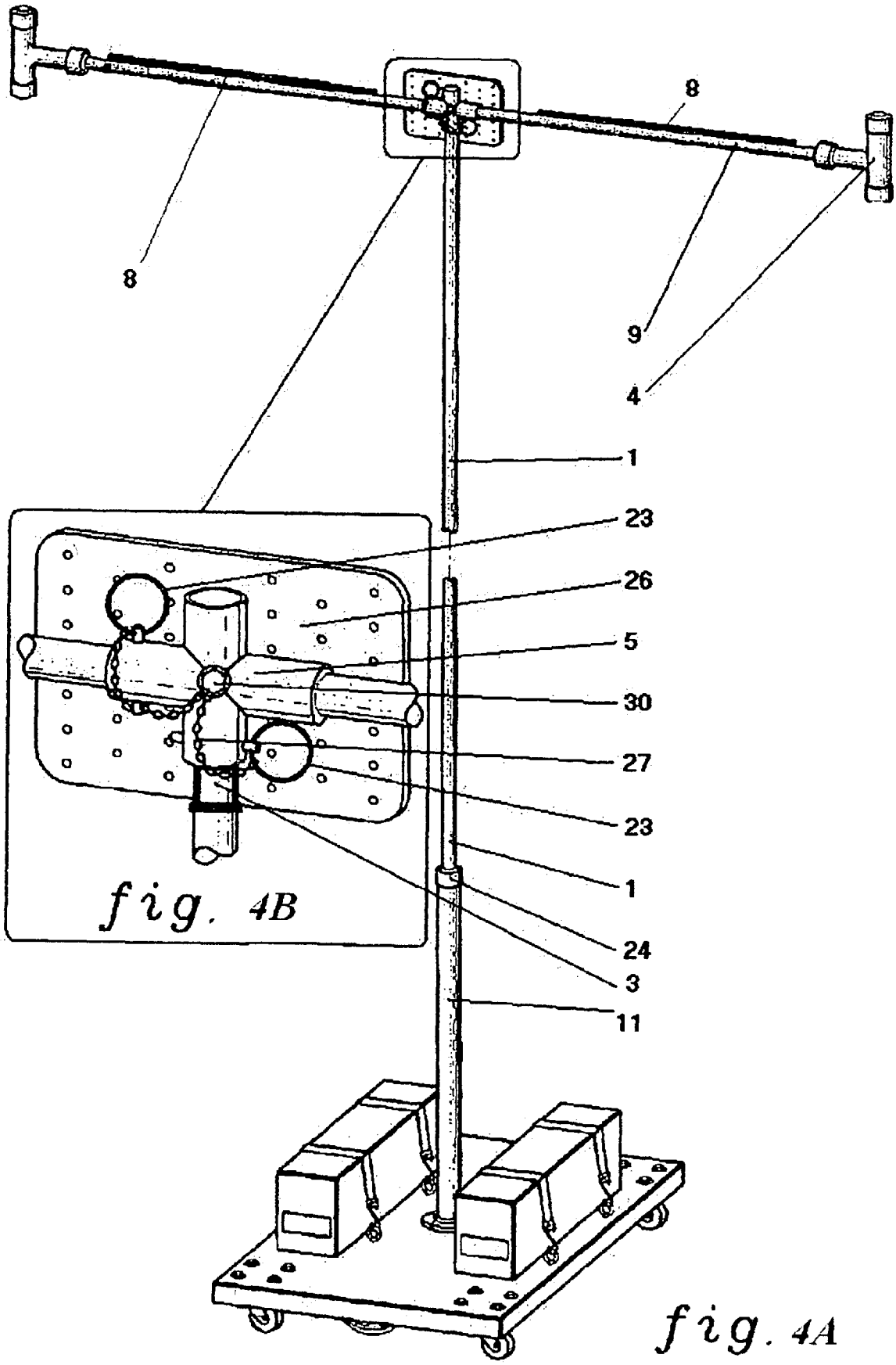
FIG. 4A shows the fully assembled invention including the mobile platform, mast base, telescopic mast, universal cross member and universal mounting plate.
FIG. 4B shows the details of the universal mounting plate and the locking hitch pins for the universal cross member.

A preferred embodiment of the antenna mount is illustrated in FIG. 1A (platform and base) and FIG. 4A (mast and universal cross member). FIG. 1A shows that the antenna mount consists of a platform 10 made of two sheets of three quarter inch thick exterior plywood glued and screwed together for an overall thickness of one and one half inches. However, the platform 10 could be made of any other material that is strong enough to support the hardware mounted to it and the weight of the antenna mount, such as heavy duty plastic. The platform 10 has four locking wheels 7 attached to it at the corners. There are two handles 16 attached to the platform so that the antenna mount can be easily carried in its disassembled state. The platform has eight eye bolts 17 attached to it that are used for attaching the rubber straps 21 to the platform 10. The rubber straps 21 will hold the other sections of the antenna mount to the platform 10 when it is in its disassembled state and the rubber straps 21 will hold the uninterruptible power supplies to the platform 10 when the antenna mount is fully assembled. In the preferred embodiment, the platform 10 has a threaded flange 22 attached to it at the center. The threaded flange 22 is used to attach the mast base 11 to the platform 10. The mast base 11 in the preferred embodiment is made of threaded metal pipe. However, the mast base 11 could be made of any material that is strong enough to support and mast 1 as shown in FIG. 4A. If threaded metal pipe was not used for the mast base 11, any other method of attaching the mast base 11 to the platform 10 could be used. The top of the mast base 11 has a threaded pipe cap 24 screwed onto it. The center of the threaded pipe cap 24 is drilled away in order to be able to insert the mast 1 as shown in FIG. 4A. This threaded pipe cap 24 acts as a reducer in the preferred embodiment. FIG. 4A shows the details of the mast 1 and the universal cross member details. In the preferred embodiment, the mast 1 is made from a standard sixteen foot telescopic aluminum pole purchased at a pool supply store. However, the mast 1 could be made of shorter lengths of inter-locking aluminum or poly vinyl chloride(PVC) sections. In the preferred embodiment, the mast 1 is sixteen feet long. That is long enough to satisfy the general height specifications for mounting wireless networking antennas. The length of the mast 1 could be changed in other embodiments. A PVC bushing 3 has been attached to the top of the mast 1. The PVC bushing 3 accepts the PVC cross 5 which supports the PVC arms 9 of the cross member and the universal mounting plate 26. The PVC cross 5, the PVC bushing 3 and one of the PVC arms 9 have holes drilled through them to accept hitch pins 23. The hitch pins 23 lock the mast 1 and one of the PVC arms 9 to the PVC cross 5. The other PVC arm 9 is glued to the PVC cross 5. The hitch pins 23 are attached to the PVC cross 5 via a length of chain 27. The purpose of attaching the hitch pins 23 to the PVC cross 5 is so that they do not become lost. Any other method of locking the sections together would be acceptable in other embodiments. A PVC tee 4 is attached to both ends of the arms 9. The PCV tee 4 is used to mount antennas to the arms 9. Several types of antennas have round bases and can be inserted into the PVC tee 4. PVC is used for the PVC bushing 3, the PVC cross 5, the PVC arms 9 and the PVC tee 4 because it is inexpensive, it is light weight yet strong and it is an electrical insulator. For antennas that can not be mounted via the PVC tee 4, a section of angle aluminum 8 has been attached to each of the PVC arms 9. Various types of mounting clips and hardware can be used on the angle aluminum 8 for mounting antennas to it. Aluminum was chosen as a material for this part because it is light weight and strong. Any material with the same properties could be used in other embodiments. A metal tie plate is attached to the PVC cross 5 and acts as the universal mounting plate 26. The universal mounting plate 26 is used for attaching various types of access points to the antenna mount. The universal mounting plate 26 has a multitude of holes in it in order to line up with the mounting screws of various types of access points. Instead of using screws to mount the access points to the mounting plate 26, elastic cords or straps could be used instead.

Operation—FIGS. 1A, 4A, 4B

Transport the invention to the site in its disassembled state. Attach two uninterruptible power supplies (UPS) to the mobile platform 10 using the rubber tarp straps 21 as designed. Screw the mast base 11 into the threaded flange 22 on the platform 10 as designed. Insert the unattached PVC arm 9 into the PVC cross 5 and insert a hitch pin 23 through the PVC arm 9 and PVC cross 5 to lock them together. Attach an access point (AP) to the universal mounting plate 26 of the using screws or elastic cords as designed. Attach one or two antennas to the arms 9 by inserting them into the ends of the PVC tee 4 or by attaching them to the angle aluminum 8. Attach the AP to the antennas via the cables provided with the antennas. Plug a network cable into the AP. Attach the universal cross member to the top of the mast 1 by inserting the PVC bushing 3 on the top of the mast 1 into the bottom of the PVC cross 5. Insert a hitch pin 23 through the junction of the PVC busing 3 and the PVC cross 5 to lock the pieces together. Insert the bottom of the mast 1 into the top of the mast base 11 that is attached to the platform 10 via the threaded flange 22. The antenna mount is now in its fully assembled state and can be taken to a location at the site where the mast 1 (telescopic pole) can be extended vertically. Plug the power supply for the AP into the UPS and turn on the UPS. The wireless networking site survey can proceed as normal by walking around the building and measuring the signal from the antennas on the antenna mount via a wireless network device. The antenna mount is moved around until the desired signal strength is achieved. After the first antenna location is determined, the unit can be moved to another location. After all antenna locations are determined, the invention can be disassembled in the reverse order as the assembly and transported from the site.

Adantages

From the description above, a number of advantages of my mobile telescopic antenna mount become evident:

(a) the antenna mount can be transported to a location in its disassembled state in a passenger vehicle, no special vehicle is required for transporting the equipment.
(b) the antenna mount is light weight can be carried in sections, this will open up the market for site surveys services to people of small stature and women.
(c) the antenna mount can be assembled in minutes which reduces the time and cost of the site survey.
(d) the antenna mount will accept various types and sizes of UPS's.
(e) the UPS's strapped to the antenna mount provides significant ballast and stability to the antenna mount.
(f) the antenna mount will accept various types and sizes of access points and antennas.
(g) the antenna mount can be adjusted in height from eight to sixteen feet to accommodate different ceiling heights if necessary.
(h) the antenna mount can be moved from location to location while it is fully functional which again reduces the time and cost of the site survey.
(i) the antenna mount can be afforded by any and all persons performing site surveys, this will eliminate the lead time to schedule site surveys because rental equipment will not need to be scheduled and delivered to the site.

Although the description above contains many specifications, these should not be construed as limiting the scope of the invention but as merely providing illustrations of some of the presently preferred embodiments of this invention. For example, the platform can be made of other materials and have different shapes, the mast can be made of different materials and have different lengths, the universal cross member can be made of different materials and provide for other means of attaching antennas.

Thus, the scope of the invention should be determined by the appended claims and their legal equivalents, rather than by the examples given.

I claim:

1. A mobile structure for affixing and transporting wireless networking access points, antennas, uninterruptible power supplies comprising:

(a) a platform having rotating wheels mounted thereunder enabling said platform to roll along a surface, (b) said platform having handles mounted thereunder enabling said platform to be carried by hand, (c) said platform having a means for attaching elastic fasteners, (d) said platform having a means for attaching independent electrical power source, (e) said platform having a method of attaching a vertical mast base, (f) said vertical mast base that will receive and support a vertical mast, (g) said vertical mast that will extend to various heights, (h) said vertical mast that will be joined with a horizontal cross member, (i) said horizontal cross member that will accommodate the mounting of wireless networking devices.

2. A method of performing a wireless networking site survey, comprising:

(a) providing a mobile structure for affixing and transporting wireless networking access points, antennas, uninterruptible power supplies, (b) transporting said structure to a site in a disassembled form, (c) assembling said structure at the site, (d) attaching wireless networking devices to said structure, (e) attaching uninterruptible power supplies to said structure, (f) supplying electrical power to said wireless networking devices by plugging them into said uninterruptible power supplies, (g) rolling said structure around said site while performing said site survey, (h) disassembling said structure after said site survey and transporting said structure away from said site.

* * * * *